US006637823B1

(12) United States Patent
Ursini et al.

(10) Patent No.: US 6,637,823 B1
(45) Date of Patent: Oct. 28, 2003

(54) CHAIR WITH REMOVABLE CUSHION AND BACK SECTIONS AND METHOD FOR PRACTICE SAME

(75) Inventors: Joseph Ursini, Staten Island, NY (US); David Warren, Tillson, NY (US)

(73) Assignee: Majestic Industries, Inc., Passaic, NJ (US)

( * ) Notice: Subject to any disclaimer, the term of this patent is extended or adjusted under 35 U.S.C. 154(b) by 0 days.

(21) Appl. No.: 09/978,281

(22) Filed: Oct. 17, 2001

Related U.S. Application Data

(60) Provisional application No. 60/240,827, filed on Oct. 17, 2000.

(51) Int. Cl.[7] ..... A47C 4/02

(52) U.S. Cl. ..... 297/440.2; 297/440.22

(58) Field of Search ..... 297/440.1, 440.2, 297/440.21, 440.22

(56) References Cited

U.S. PATENT DOCUMENTS 4,099,774 A * 7/1978 Sandham ..... 297/440.22
4,395,071 A * 7/1983 Laird ..... 297/440.21
4,488,755 A * 12/1984 Nemschoff ..... 297/440.21
5,110,186 A * 5/1992 Clark et al. ..... 297/440.2
5,184,871 A * 2/1993 LaPointe et al. ..... 297/440.21
5,520,441 A * 5/1996 Citton ..... 297/440.21
5,779,317 A * 7/1998 Neal ..... 297/440.2
6,135,562 A * 10/2000 Infanti ..... 297/440.2
6,149,240 A * 11/2000 Pietrzak ..... 297/440.22
6,305,750 B1 * 10/2001 Buono et al. ..... 297/440.2

* cited by examiner

*Primary Examiner*—Peter R. Brown
(74) *Attorney, Agent, or Firm*—Dorsey & Whitney LLP

(57) ABSTRACT

A chair with one or more easily removable pieces and a method for disassembling the same. The chair preferably includes a seat section, a back section, and a concealed back-releasing mechanism. The back-releasing mechanism includes a connecting bracket, attached to the seat section, wherein the connecting bracket includes a protruding portion, and a receiving bracket concealed in the back section and that includes a recessed portion that receives the protruding portion of the connecting bracket. The chair may also include a seat section, a back section connected to the seat section, a cushion, and a concealed cushion-releasing mechanism. The cushion-releasing mechanism preferably comprises at least one slot in the seat section, wherein the slot is defined by the seat section and extends through the seat section and at least one tongue, wherein the tongue protrudes from the cushion and extends through the slot.

12 Claims, 6 Drawing Sheets

CHAIR WITH REMOVABLE CUSHION AND BACK SECTIONS AND METHOD FOR PRACTICE SAME

CROSS-REFERENCE TO RELATED APPLICATIONS

This application hereby claims the benefit of the priority of U.S. Provisional Patent Application, Serial No. 60/240,827, filed Oct. 17, 2000, which is hereby incorporated by reference. This application also hereby incorporates by reference U.S. patent application, Ser. No. 09/661,378, entitled "Quick Release Extrusion Bracket With A Secure Lock" and filed Sep. 13, 2000.

BACKGROUND

1. Field of the Invention

The present invention relates to chairs and more particularly to chairs with removable and replaceable pieces.

2. Description of Related Art

In many industries, it is necessary to be able to easily and quickly remove and replace pieces of a chair. Such industries include the casino industry and the movie cinema industry. In both of these industries, chairs are constantly and regularly used. The constant and regular use unfortunately produces great wear and tear on the chair. Moreover, it both industries it is greatly important that the customer using the chairs is always comfortable. Therefore, the chair pieces must be easily, quickly and reliably removable and replaceable.

Existing examples of chairs that have removable and replaceable pieces include chairs that use products like Velcro to attach a cushion to an underlying and supporting seat. However, such chairs are disadvantageous because the Velcro fills up with lint over time and tends to eventually not stick very well, if at all. Further, with Velcro attachments, patrons can easily walk off with the cushions or the cushions can fall off. The same applies to chairs that include back sections attached with Velcro and the like. Consequently, chairs with Velcro and like attachments are not reliable or secure.

Accordingly, the present art does not satisfy the demand for easy, quick, reliable, and secure removal and replacement of chair pieces.

SUMMARY OF THE INVENTION

An advantage of the present invention is that it overcomes the disadvantages and shortcomings of the prior art. Another advantage of the present invention is that it provides chairs with pieces that may be easily, quickly, reliably, and securely removed. Yet, another advantage of the present invention is that it provides cushion and back release mechanisms that are secure and reliable. Still another advantage of the present invention is that it provides methods for reliably securing cushion and back sections to a chair and for easily and quickly removing and replacing cushions and back sections. Moreover, another advantage of the present invention is that it provides chairs with cushion and back sections that may not be readily removed by customers, patrons or other persons that do not know how the release mechanisms operate. Similarly, another advantage of the present invention is that the manner of operating the release mechanisms is not readily discernible to customers or patrons.

These and other advantages of the present invention are achieved by a chair with an easily removable piece, wherein the manner of removing the piece is secure. The chair preferably comprises a seat section, wherein the seat section supports a person sitting on the chair when the chair is in use, a back section, and a concealed back-releasing mechanism. The back-releasing mechanism includes a connecting bracket, attached to the seat section, wherein the connecting bracket includes a protruding portion, and a receiving bracket, attached to the back section. The receiving bracket is concealed in the back section and includes a recessed portion that receives the protruding portion of the connecting bracket, thereby removably connecting the back section to the seat section.

These and other advantages of the present invention are also achieved by a method for the disassembling a chair with an easily removable piece, wherein the manner of removing the piece is secure. The method preferably comprises the steps of providing a chair that includes a seat section, a back section removably connected to the seat section, and a concealed back-releasing mechanism, wherein the back-releasing mechanism includes a connecting bracket and a receiving bracket, the connecting bracket partially positioned within the receiving bracket and withdrawing the connecting bracket from the receiving bracket, wherein the back section is disconnected from seat section. The method may also comprise providing a chair including a cushion, removably connected to the seat section, and a concealed cushion-releasing mechanism that includes at least one slot in the seat section that is defined by the seat section and extends through the seat section and at least one tongue that protrudes from the cushion and extends through the slot and removing the tongue from the slot, wherein the cushion is disconnected from the seat section.

These and other advantages of the present invention are also achieved by a chair with an easily removable piece, wherein the manner of removing the piece is secure. The chair preferably comprises a seat section, a back section connected to the seat section, a cushion, and a concealed cushion-releasing mechanism. The cushion-releasing mechanism preferably comprises at least one slot in the seat section, wherein the slot is defined by the seat section and extends through the seat section and at least one tongue, wherein the tongue protrudes from the cushion and extends through the slot, thereby removably connecting the cushion to the seat section.

Other aspects and advantages of the present invention will become apparent from the following detailed description, which, when taken in conjunction with the accompanying drawings, illustrates by way of example the principles of the present Invention.

Same numerals in FIGS. 1–4B are assigned to similar elements in all the figures. Embodiments of the present invention are discussed below with reference to FIGS. 1–4B. However, those skilled in the art will readily appreciate that the detailed description given herein with respect to these figures is for explanatory purposes as the present invention extends beyond these limited embodiments.

DETAILED DESCRIPTION OF THE INVENTION

Figure 1:
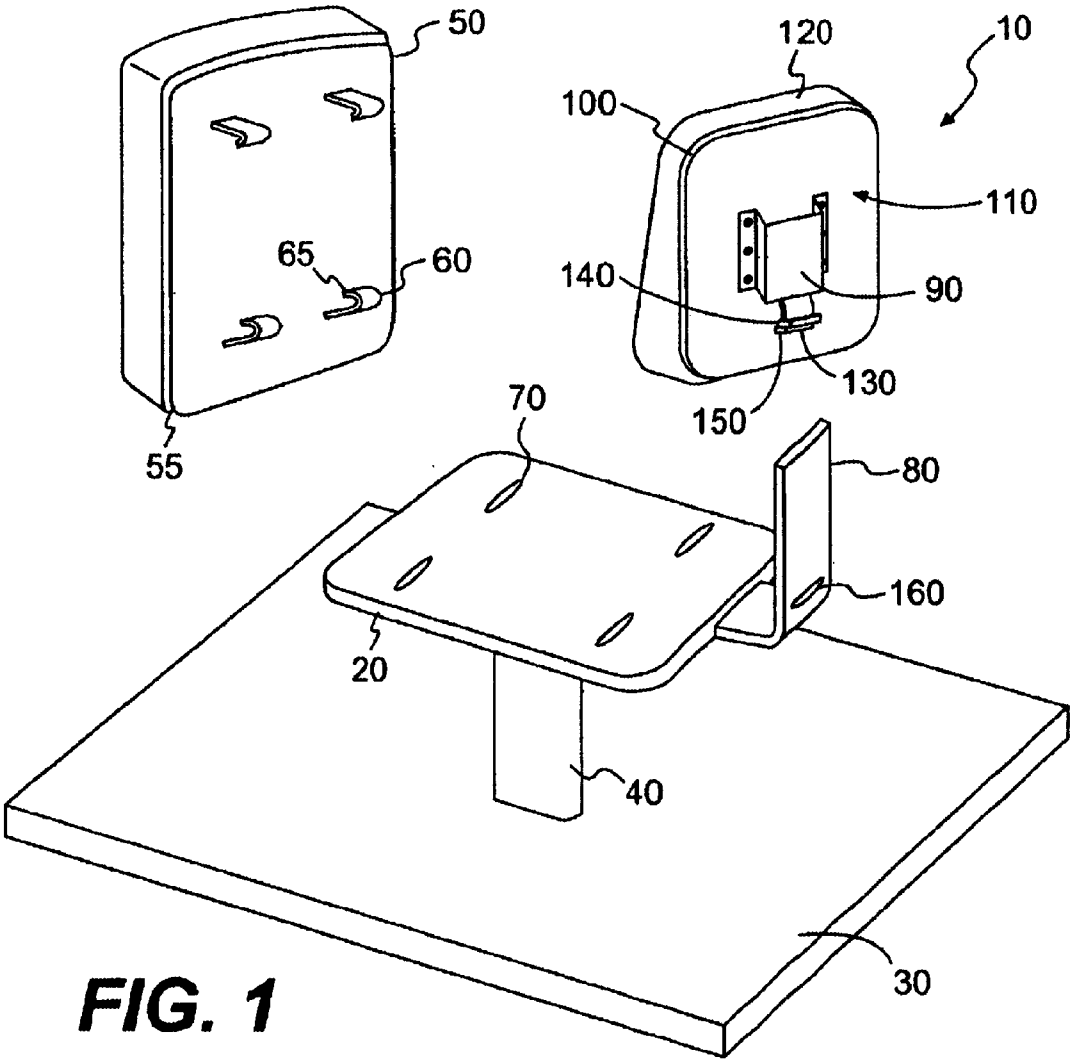
FIG. 1 illustrates a perspective view of a chair according to the present invention.

FIG. 1 illustrates a perspective view of the detached components of a first embodiment of a chair 10 according to the present invention. The chair 10 includes a seat section 20 that is supported above the floor 30 by a column 40 that extends vertically from and that is fixed to the floor 30. The seat section 20 can also be supported by legs (not illustrated) that are not fixed to the floor 30. Further, the column 40 can extend vertically from and be fixed to a platform (not illustrated) that can be moved, thereby allowing the chair 10 to be moved to a different location.

As an alternative to being attached to the floor 30, the chair 10 can be attached to a base plate. When attached to a base plate, base plate can be disengaged from the floor and the chair 10 can more easily be moved to another location. Such a base plate, and a mechanism for securing the base plate to the floor, is described in the above-incorporated U.S. Patent Application entitled "Quick Release Extrusion Bracket With A Secure Lock".

A first easily removable piece, such as a cushion 50 illustrated in FIG. 1, may be placed on and supported by the seat section 20. Providing a removable cushion 50 enables the cushion 50 to be disposed when stained, torn, or otherwise worn. The seat section 20 can be made from or include wood, such as ½-inch thick plywood, or other materials such as, but not limited to, polyvinyl chloride (PVC) or other plastics. The cushion 50 makes the chair 10 more comfortable by providing padding. The cushion 50 preferably includes a cushion backing 55 made from any of a variety of materials, including without limitation, plastic and wood.

According to an alternative embodiment, a plastic seat section 20 can be molded directly into a foam material that forms the core of the cushion 50. Such embodiments provide a convenient disposable seat section 20 and cushion 50 that may also be thrown away when a new cushion 50 is needed, such as when the cushion 50 tears or has a been spilled upon.

Referring again to FIG. 1, the cushion 50 preferably includes four tongues 60 protruding from the cushion 50, though the number of tongues 60 is not limiting of the present invention. Each tongue 60 preferably includes a lip 65. Likewise, the seat section 20 preferably includes a corresponding slot 70 with which each tongue 60 engages when the chair 10 is assembled. Together, the tongues 60 and the slots 70 comprise a cushion-release mechanism. The slots 70 are formed in the seat section 20 and preferably extend completely through the seat section 20. When assembling the chair 10, the tongues 60, which preferably are elastic, bend as the lips 65 travel through the slots 70. After the lips 65 pass through the slots 70, the tongues 60 preferably return to their unbent shape, thereby biasing the lips 65 towards an edge of the slot 70. Biased as such, the lips 65 secure and prevent the tongues 60 from disengaging from the slots 70, thereby securing the cushion 50 to the seat section 20 unless the lips 65 are de-biased away from the edges of the slots 70.

Attached to or formed in the rear of the seat section 20 is a connecting bracket 80 that extends outward and upward from the seat section 20. In FIG. 1, an L-bracket is illustrated as the connecting bracket 80. When the chair 10 is assembled, the connecting bracket 80 is preferably engaged with a receiving bracket 90 that is attached to a back section 110. Together, the connecting bracket 80 and the receiving bracket 90 constitute a back-releasing mechanism. Preferably, the receiving bracket 90 is attached to a backing 100 of the back section 110, as illustrated in FIG. 1. The back section 110 is a second removable piece of the chair 10 shown in FIG. 1 and may also include a back cushion 120 upon which persons sitting in the chair 10 may comfortably lean when sitting down. In alternative embodiments, the back section 110 is the only removable piece of the chair 10.

The receiving bracket 90 preferably includes a spring 130. A handle 140, for exerting a de-biasing force against the spring 130, is preferably connected to the spring 130. The spring 130 preferably includes a tab 150 that engages with a recessed region 160 in the connecting bracket 80. The recessed region 160 may extend either partially or fully through the connecting bracket 80. In use, the spring 130 preferably biases the tab 150 towards the connecting bracket 80 so that the tab 150 is inserted into the recessed region 160 when aligned therewith. The handle 140 is used to de-biases the tab 150 away from the connecting bracket 80, removing the tab 150 from the recessed region 160.

Though the chair 10 illustrated in FIG. 1 has a visible receiving bracket 90, certain embodiments of the present invention conceal the presence of the receiving bracket 90. For example, a cover (not shown) can be included in the back section 110. In this case, the receiving bracket 90 is positioned under the cover. As an alternative, the back cushion 120 can be formed such that it envelops the backing 100 and the receiving bracket 90. In either of these embodiments, the handle 140 may be reached by someone wishing to remove the back section 110 of the chair 10.

Figure 2A:
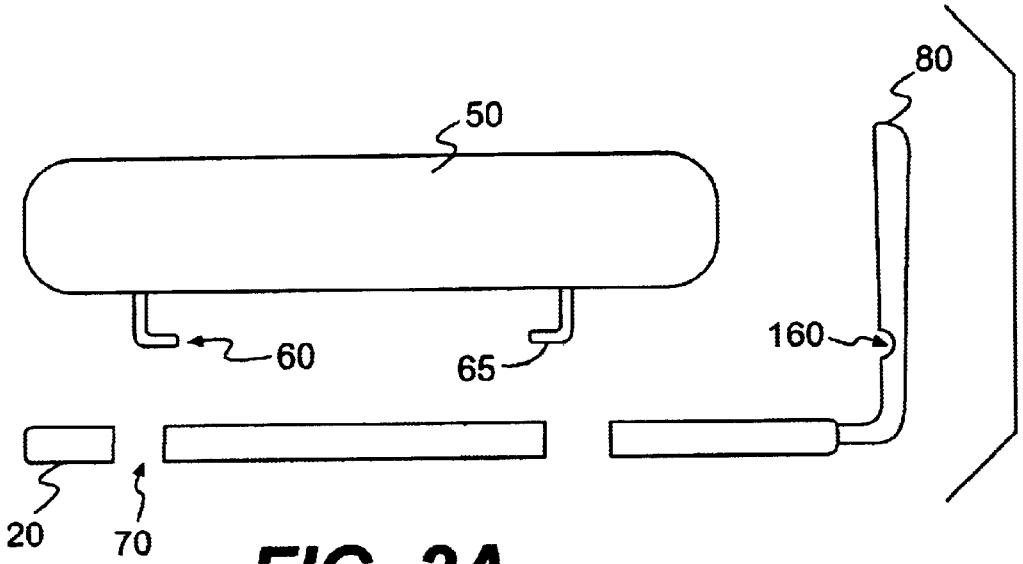
FIG. 2A illustrates a cross-sectional view of a chair wherein the seat cushion is detached or disengaged from the remainder of the chair.

FIG. 2A illustrates a cross-sectional view of a chair 10 with a cushion 50 that is disengaged or disconnected from the seat section 20. As shown, the tongues 60 align with the corresponding slots 70. The lips 65 on each tongue 60 may face different directions, as shown, to better secure the cushion 50 to the seat section 20. In the embodiment illustrated in FIG. 2A, the recessed region 160 in the connecting bracket 80 faces the seat section 20 (i.e., the front) of the chair 10. This embodiment also has a cushion 50 that does not extend completely to the connecting bracket 80.

Figure 2B:
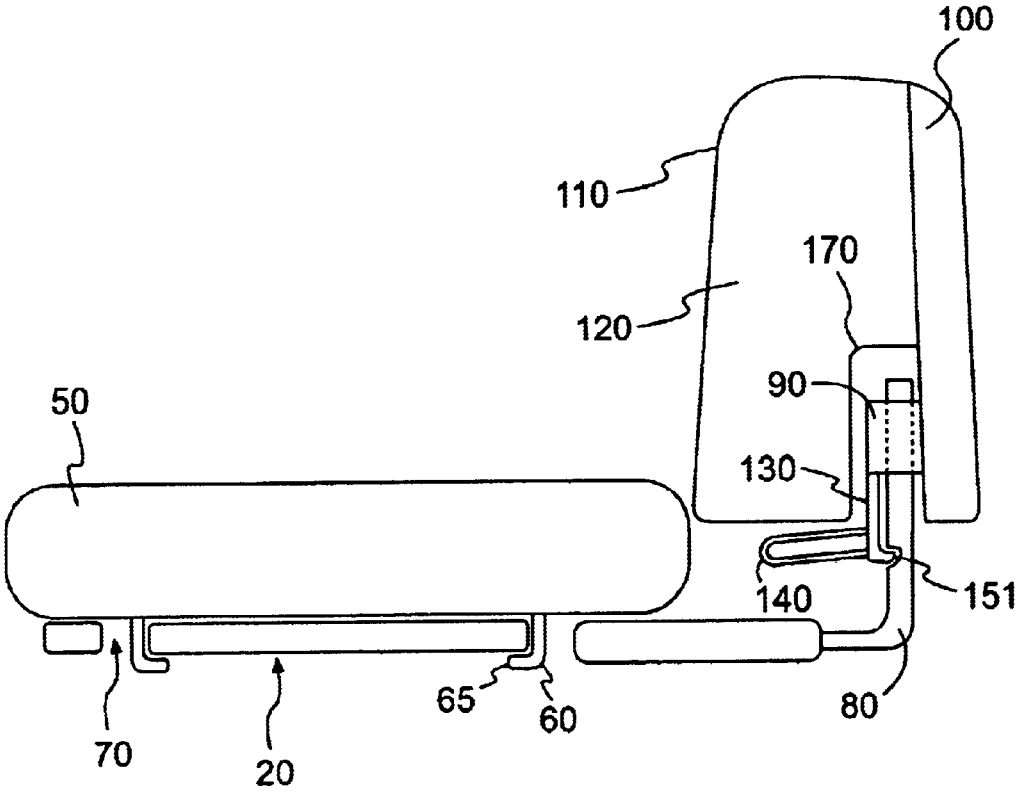
FIG. 2B illustrates a cross-sectional view of a chair wherein a seat cushion and a back section that includes a back cushion are attached to the remainder of the chair.

FIG. 2B illustrates a cross-sectional view of the chair 10 shown in FIG. 2A when the cushion 50 is engaged with or connected to the seat section 20 and when the back section 110 is also engaged with or connected to the seat section 20 (via the connecting bracket 80). As discussed above, the back section 110 preferably includes the back cushion 120 and the backing 100. The backing 100 is preferably made from a more rigid material than the back cushion 120. For example, the backing 100 may be made from wood (e.g., plywood) or a plastic.

The back section 110 illustrated in FIG. 2B includes a cavity 170 that is formed in the interior of the back section 100 (e.g., in the back cushion 120 or between the back cushion 120 and the backing 100) and that accommodates the presence of both the receiving bracket 90 and the connecting bracket 80 when engaged. According to this embodiment, the receiving bracket 90 is connected to the backing 100 and the handle 140 is on the front side of the chair 10 when the chair 10 is assembled. The handle 140 is preferably designed so that the handle 149 remains concealed by the back section 110 and the cushion 50 while still being accessible for use.

The tongues 60 protrude directly from the cushion 50 in the embodiment shown. Alternatively, the tongues 60 protrude from a cushion backing 55. The tongues 60 are engaged with the slots 70 in the seat section 20. Hence, the tongues 60 have passed through the slots 70 and the lips 65 protruding from the tongues 60 are positioned underneath non-slotted areas of the seat section 20. As discussed above, the tongues 60 bias the lips 65 towards an edge of each slot 70, securing the tongues 60 in the slots 70. In order to remove the cushion 50 from the chair 10 in FIG. 2B, the tongues 60 are bent or de-biased away from the edges of each slot 70 until the lips 65 are completely within the slots 70.

Referring again to the embodiment illustrated in FIGS. 2A and 2B, when both the cushion 50 and the back section 110 are connected to the chair 10, the handle 140 is preferably completely concealed from a person sitting on the chair 10 and the person would not normally feel the handle 10. When disassembling the chair 10 to remove either the cushion 50 or the back section 110, the cushion 50 may be removed first, thereby exposing the handle 140. Then, the handle 140 may be pulled toward the front of the chair 10, thereby bending or de-biasing the spring 130 into a position where the tab 150 protruding from the spring 130 disengages from the recessed region 160 in the connecting bracket 80. Once the tab 150 is disengaged, the back section 110 may be lifted upward and removed from the chair 10.

Alternatively, the back section 110 is removed without removing the cushion 50 or without removing the cushion 50 first. In this embodiment, a user preferably reaches between the cushion 50 and the back cushion 120 to access the handle 140. Preferably, the cushion 50 and the back cushion 120 both have enough flexibility to enable the user to access and pull on the handle 140. The user then pulls the handle 140, de-biasing the spring 130 and disengaging the tab 150 as described above, and lifts the back section 110 from the chair.

Figure 3A:
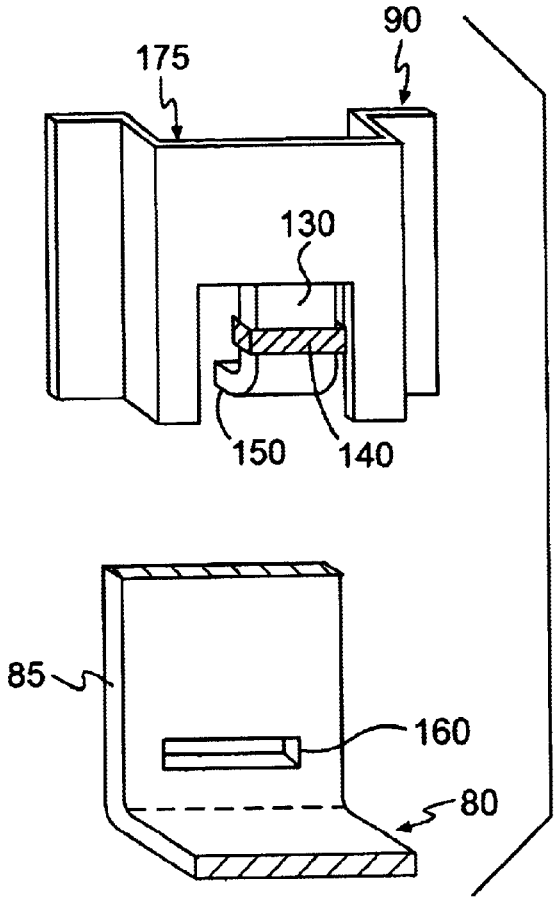
FIG. 3A illustrates a perspective view of a back-releasing mechanism according to the present invention when the mechanism is disengaged.
Figure 3B:
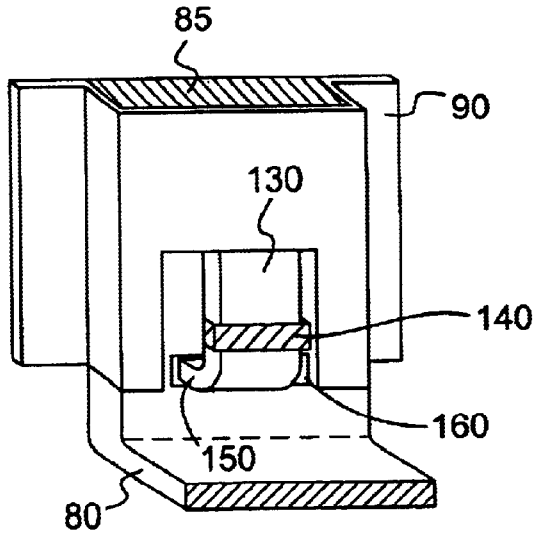
FIG. 3B illustrates a perspective view of a back-releasing mechanism according to the present invention when the mechanism is engaged.

FIGS. 3A–B illustrate perspective views of the components of a back-releasing mechanism according to the present invention. Namely, FIGS. 3A–B illustrate the connecting bracket 80, the receiving bracket 90, the spring 130, the handle 140, and the recessed region 160 discussed above. In addition, FIGS. 3A–B illustrate a recessed portion 175 of the receiving bracket 90 that receives a protruding portion 85 of the connection bracket 80 when the connection bracket 80 and the receiving bracket 90 engage. The receiving bracket 90 is preferably attached to the backing 100 of the back section 110 (not shown in FIGS. 3A–B), as described above, thereby forming an enclosed region between the recessed portion 175 and the backing 100 that encloses the protruding portion 85 of the connection bracket 80.

FIG. 3A shows the components of the back-releasing mechanism when they are disengaged. In this figure, the recessed portion 175 of the receiving bracket 90 is empty. FIG. 3B shows the components of the back-releasing mechanism when they are engaged. As illustrated, the protruding portion 85 of the connecting bracket 80 is positioned within the recessed portion 175 of the receiving bracket 90 and the tab 150 is engaged with the recessed region 160 in the connecting bracket 80.

Not illustrated is how the receiving bracket 90 is connected to the back section 110 or how the connecting bracket 80 is connected to the seat section 20. Each of the brackets 80 or 90 may be molded directly into the section 20 or 110 to which they are attached or the brackets 80 or 90 can be bolted, screwed, glued, or otherwise attached.

Figure 4A:
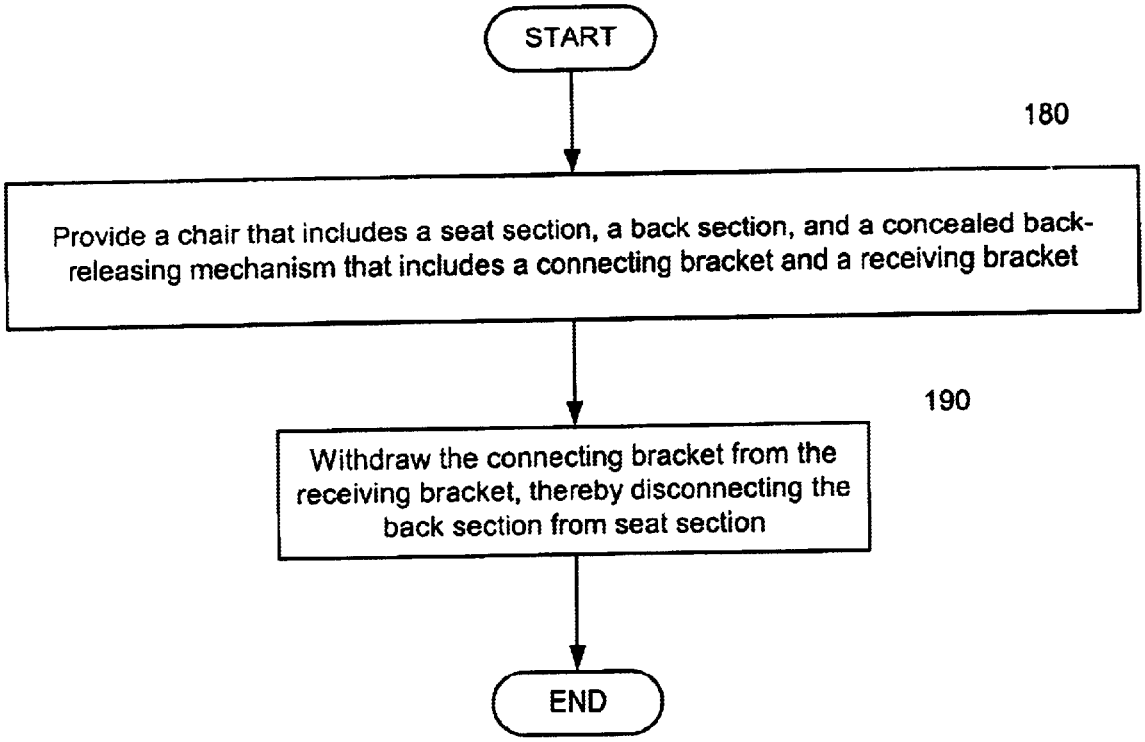
FIG. 4A is a flowchart of a method for disconnecting the back section of the chair from the seat section.
Figure 4B:
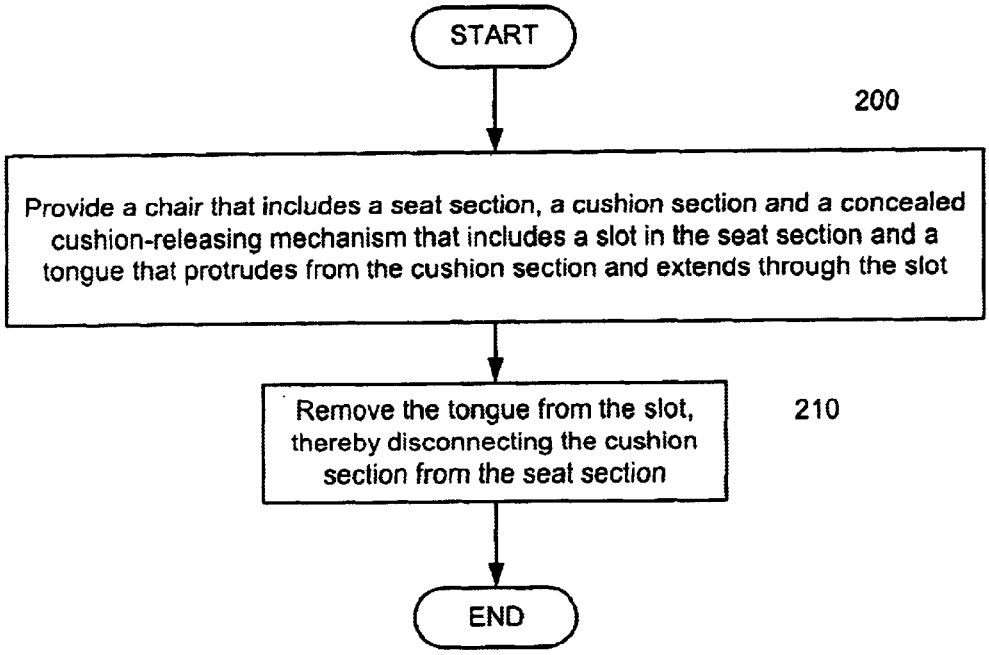
FIG. 4B is a flowchart of a method for disconnecting the cushion of the chair from the seat section.

FIGS. 4A–B illustrate flowcharts of methods according to the present invention for disassembling a chair 10 with an easily removable piece. Both of these flowcharts relate to chairs 10 that include a secured manner of removing the piece in question. For example, the flowcharts may relate to a chair 10 that had a manner of removing either the cushion 50 or the back section 110, so long as the manner of removing either piece prevents certain users from readily removing either the cushion 50 or the back section 110. For example, users that would be prevented include those users who are not familiar with how the cushion 50 or the back section 110 are attached.

The first step 180 in FIG. 4A specifies that providing a chair 10 that includes a seat section 20, a back section 110, and a concealed back-releasing mechanism, such as the one illustrated in FIGS. 1–3B when positioned either in the cavity 170 or under a cover. According to the first step 180, the back-releasing mechanism also includes the connecting bracket 80 and receiving bracket 90 illustrated in FIGS. 1–3B. The second step 190 specifies that the user withdraw the connecting bracket 80 from the receiving bracket 90, thereby disconnecting the back section 110 from seat section 20. The second step preferably involves the user pulling the handle 140 such that the tab 150 becomes disengaged from the recessed region 160 and lifting the back section 110 up and away from the seat section 20.

The first step 200 in FIG. 4B specifies providing a chair 10 that includes a seat section 20, a cushion 50, and a concealed cushion-releasing mechanism such as the tongues 60, lips 65, and slots 70 illustrated in FIGS. 1–2B. These components are concealed in the sense that they are not ordinarily visible to a user of the chair 10 unless the user specifically looks under the cushion 50. The first step 200 also specifies that the mechanism includes a slot 70 in the seat section 20 and a tongue 60 that protrudes from the cushion 50 and extends through the slot 70 as shown in FIGS. 1–2B. The second step 210 then specifies that the user remove the tongue 60 from the slot 70, thereby disconnecting the cushion 50 from the seat section 20.

Figure 5:
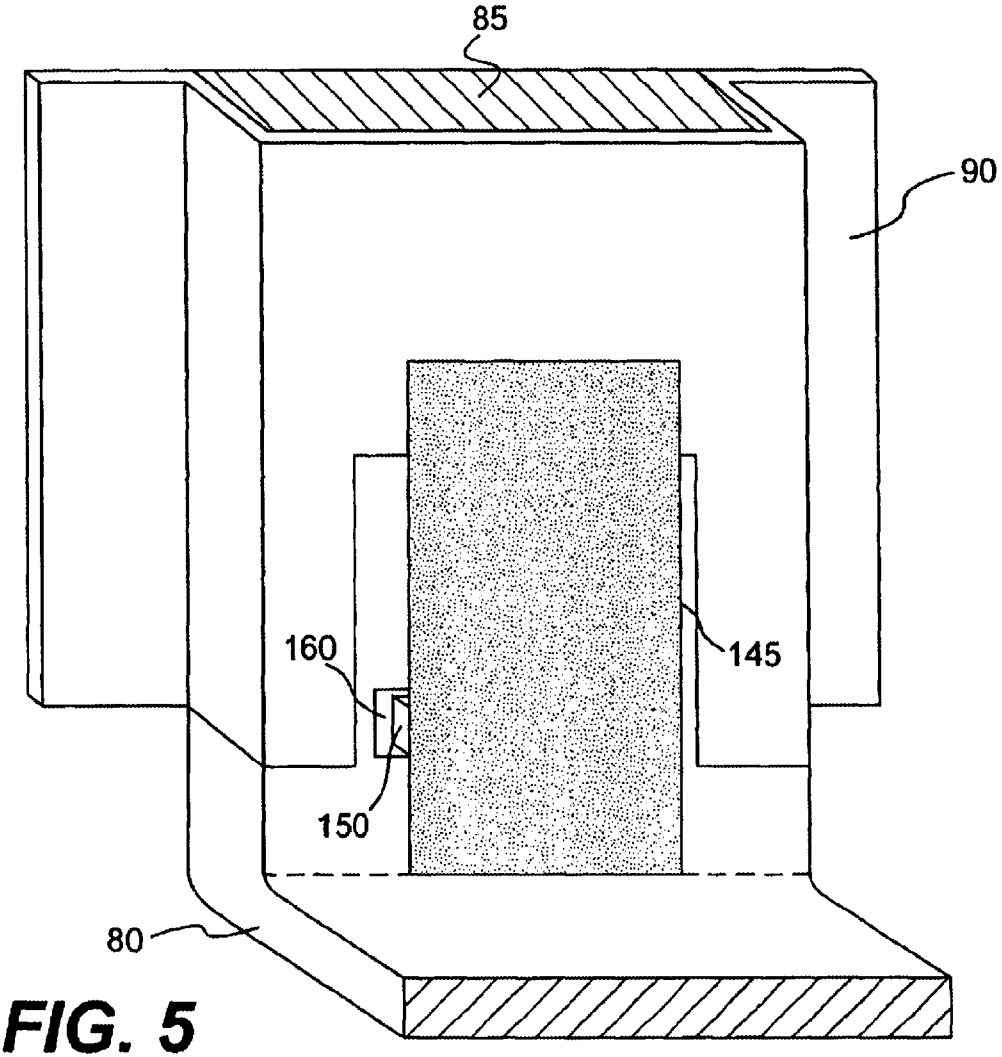
FIG. 5 illustrates a perspective view of back-releasing mechanism according the present invention with a lock when the mechanism is engaged.

FIG. 5 shows the components of the back-releasing mechanism, when they are engaged, with a lock 145 that prevents the handle 140 from being used to bias the tab 150 away from the protruding portion 85 of the connecting bracket 80.

While the invention has been described with reference to the exemplary embodiments thereof, those skilled in the art will be able to make various modifications to the described embodiments of the invention without departing from the true spirit and scope of the invention. The terms and descriptions used herein are set forth by way of illustration only and are not meant as limitations. In particular, although the method of the present invention has been described by examples, the steps of the method may be performed in a different order than illustrated or simultaneously. Those skilled in the art will recognize that these and other variations are possible within the spirit and scope of the invention as defined in the following claims and their equivalents.

What is claimed is:

1. A chair with an easily removable piece, wherein a manner of removing the piece is secure, the chair comprising:

a seat section;

a back section; and a concealed back-releasing mechanism including:

a connecting bracket, attached to the seat section, wherein the connecting bracket includes a protruding portion; and a receiving bracket, attached to the back section, wherein the receiving bracket is concealed in the back section and includes:

a recessed portion that receives the protruding portion of the connecting bracket, thereby removably connecting the back section to the seat section;

a spring protruding from the recessed portion;

a tab protruding from the spring, wherein the spring biases the tab towards the protruding portion of the connecting bracket; and a handle connected to the spring, wherein the handle enables a force to be exerted against the spring, biasing the tab away from the protruding portion of the connecting bracket.

2. The chair of claim 1, further comprising a cushion secured to the seat section.

3. The chair of claim 2 wherein the cushion is a hard material that is resistant to wear.

4. The chair of claim 2 wherein the cushion includes a backing of a material chosen from the list consisting of: wood and plastic.

5. The chair of claim 1, wherein the connecting bracket is an L-bracket.

6. The chair of claim 1, wherein the back portion includes a cushion that has a cavity and the receiving bracket is positioned and concealed within the cavity.

7. The chair of claim 1, wherein the connecting bracket further includes a recessed region in the protruding portion, wherein the recessed region accepts the tab, so that the biased tab inserts into the recessed region thereby securing the receiving bracket and the connecting bracket together.

8. The chair of claim 7, wherein the recessed region extends through protruding portion of the connecting bracket.

9. The chair of claim 1, wherein the back-releasing mechanism includes a lock that prevents the handle from being used to bias the tab away from the protruding portion of the connecting bracket.

10. The chair of claim 1, further comprising:

a cushion; and a concealed cushion-releasing mechanism, comprising:

at least one slot in the seat section, wherein the slot is defined by the seat section and extends through the seat section; and at least one tongue, wherein the tongue protrudes from the cushion and extends through the slot, thereby removably connecting the cushion to the seat section.

11. The chair of claim 10, wherein the tongue includes a lip on an end of the tongue that extends through the slot and the lip is biased towards an edge of the slot, thereby securing the tongue in the slot so that the cushion cannot normally be removed from the seat section without de-biasing the lip and releasing the lip from the edge of the slot.

12. The chair of claim 10, wherein the cushion-releasing mechanism includes a plurality of tongues and slots.

* * * * *